US006387154B1

(12) United States Patent
Frommeyer et al.

(10) Patent No.: US 6,387,154 B1
(45) Date of Patent: May 14, 2002

(54) PROCESS FOR SEPARATING MOLTEN METALS

(75) Inventors: Georg Frommeyer, Erkrath; Wilfried Knott; Andreas Weier, both of Essen, all of (DE)

(73) Assignee: Th. Goldschmidt AG, Essen (DE)

( * ) Notice: Subject to any disclaimer, the term of this patent is extended or adjusted under 35 U.S.C. 154(b) by 0 days.

(21) Appl. No.: 09/510,860

(22) Filed: Feb. 23, 2000

(30) Foreign Application Priority Data

Feb. 24, 1999 (DE) ..... 199 07 857

(51) Int. Cl.[7] ..... C22B 9/10
(52) U.S. Cl. ..... 75/585; 420/590
(58) Field of Search ..... 75/414, 585, 604, 75/609, 684, 621, 663; 420/590

(56) References Cited

U.S. PATENT DOCUMENTS 2,983,597 A * 5/1961 Elliott ..... 75/684
3,940,262 A * 2/1976 Niebylski et al. ..... 75/684
5,462,612 A * 10/1995 Morita et al. ..... 148/439

OTHER PUBLICATIONS

Jurgen Falbe et al.,(1991),"Römpp Chemie Leikon", Georg Thieme Verlag Stuttgart.New York, 9th Edition, p. 3230 No month.

* cited by examiner

*Primary Examiner*—Roy King
*Assistant Examiner*—Tima McGuthry-Banks
(74) *Attorney, Agent, or Firm*—Scully, Scott, Murphy & Presser

(57) ABSTRACT

A process for separating molten metals, the molten metals being treated with metal hydrides is provided. The molten metals employed are from Groups II–IV of the Periodic Table of Elements and the subgroups, including their alloys, and are distinguished by the fact that the metals or alloys are reacted with a metal hydride in a molten bath.

15 Claims, No Drawings

PROCESS FOR SEPARATING MOLTEN METALS

DESCRIPTION

1. Field of Invention

The present invention relates to a process for separating molten metals, and more particularly to a process for separating molten metals that are treated with metal hydrides.

2. Background of the Invention

As is well known in the art, magnesium, aluminum and zinc, as well as their alloys, and numerous other nonprecious metals become covered with a more or less protective oxide skin (passivation) even under environmental influences. This skin formation may cause undesirable gray discoloration of the metals. This is seen in the case of aluminum, wherein it is known that impurities such as iron, silicon and other foreign metals, as well as reaction products thereof, reduce the transparency of the oxide film which is formed and impart a matt gray color to the surface (Kirk-Othmer, Encyclopedia of Chemical Technology, 4th Ed., Vol. 2, p. 247).

On the other hand, the passivity of nonprecious metal oxide layers opens up numerous applications to such metals. Treating the metals with reducing agents, e.g., with nascent hydrogen and hydrogen gas at elevated temperatures, leads to a loss of passivity (Römpps Chemie Lexikon, 9th Edition (1991), p. 3230).

SUMMARY OF THE INVENTION

The present invention is directed to a process for separating molten metals selected from Groups II–IV of the Periodic Table of Elements or their alloys by treating the molten metal or alloy thereof with a metal hydride. The process of the present invention produces metals which have a highly reflective surface, yet are highly resistant to tarnishing. That is, the metals produced in the present invention are passivated and are not adversely affected by customary environmental influences.

DETAILED DESCRIPTION OF THE INVENTION

A first embodiment of the present invention comprises a process for separating molten metals of principal groups II–IV of the Periodic Table of Elements as well as their subgroups and alloys, wherein the metals or alloys are reacted with a metal hydride in a molten bath.

When metals or alloys are melted in the presence of metal hydride, a separation of metal or alloy constituents is observed. This is revealed, for example, by the formation of a grainy layer covering the molten material or the solidified regulus. Following this treatment, the metals or metal alloys exhibit a changed chemical composition compared to the untreated starting material.

In a preferred embodiment of the present invention, the metals are selected from those which, under standard environmental conditions, are subject to external passivation. In particular, the metals employed in the present invention are metals which form an oxide skin under standard environmental conditions. Therefore, it is preferable in the context of the present invention for these metals to be selected from nonferrous metals and nonprecious metals, and more preferably selected from magnesium, calcium, aluminum, silicon, titanium or zinc, and their alloys. The term "alloy" is used in the context of the present invention to denote a composition that contains at least 30% by weight of said metal.

Another embodiment of the present invention comprises reacting metals or metal alloys with metal hydrides of one of the metals which are to be separated. For example, to separate magnesium, it is particularly advantageous to use magnesium hydride. Similarly, of course, it is also possible to use mixed metal hydrides in the case of alloys. In the same way, however, it is also possible to deliberately introduce new material components into the metal alloy by specifically selecting the metal hydride or hydrides.

A still further embodiment of the present invention consists of setting a molar ratio of metal, including alloys, to metal hydride in the range from 1:0.0001 to 1:100, preferably in the range from 1:0.001 to 1:0.01, and even more preferably in the range from 1:0.005 to 1:0.03. By carrying out the reaction of the present invention in the ranges mentioned above, repeated treatment is typically unnecessary. Thus, the present invention significantly reduces the cost of separating molten metals. This provides an economic advantage over prior art processes.

Using the present invention it is therefore possible to remove impurities, in particular, volatile impurities which form metal hydride, from a metal.

The metals or alloys are treated with the metal hydrides in the molten state. It is advantageous to use the hydrides whose metals also act as alloying components in the metal matrix.

The present invention unexpectedly provides a metal which has a reflective surface, yet is passivated such that unwanted reactions caused by customary environments, i.e., tarnishing, does not occur.

For example, for lamp reflectors and shiny decorative effects in the automotive and mechanical engineering sectors, it is desired to use high-purity alloys which guarantee maximum reflection and shine (Kirk-Othmer, Encyclopedia of Chemical Technology, 4th Ed., Vol. 2, p. 247). The purity of the metal, and its surfaces, is therefore directly linked to the observed shine and reflectivity, so that it is possible to deduce directly from this relationship that the metals obtained using the process according to the present invention are of very high purity. In view of the fact that commercially available metals are often used with a purity of almost 100%, and these metals are passivated in relation to environmental atmospheres such as air using separate processes, the process according to the present invention is an efficient refining process, for example, for the removal of impurities, and especially, volatile impurities which form metal hydrides.

For example, if a small amount of autocatalytically produced magnesium hydride (TEGO-Magnan®) is applied to a pulverulent Al—Mg alloy, and this mixture is heated in a muffle to approx. 1000° C., the solidified metal, which is obtained after the reaction mixture has cooled, has shiny, bright silver-colored external and internal surfaces which do not become tarnished even after they have been stored for months in ordinary air. It was also possible to make a similar observation when zinc (electrolytic zinc) was reacted with magnesium hydride. In addition to a shiny silver-colored surface which was stable under environmental atmospheres, the impurity levels of lead, tin, iron and copper had fallen considerably.

The following examples are given to illustrate the present invention and to demonstrate some advantages that can arise therefrom.

EXAMPLES

Example 1

A steel capsule was charged with a mixture comprising 500 g of a 99.5% by weight magnesium powder and 10 g of a 95% by weight autocatalytically produced magnesium hydride (Tego Magnan®), and was heated to 750° C. in an induction furnace which had been washed with an inert gas. The temperature was held for about 3 minutes, and then the reaction mixture was cooled. The result was a regulus which was studded with shiny, bright silver-colored cavities and which did not exhibit any tendency to tarnish either at these cavity surfaces generated by the process or at bright silver-colored sawn surface, even after it had been stored for 3 months in a standard atmosphere.

The ultimate chemical analysis shown in Table 1 clarifies the separation process which is achieved by the hydride treatment:

TABLE 1

| Specimen | Description | % Al | % Cu | % Fe | % Si | % Zn |
|---|---|---|---|---|---|---|
| Mg | (starting condition) | 0.22 | <0.001 | 0.073 | 0.0054 | 0.0017 |
| Mg | (after treatment with magnesium hybride) | 0.0093 | <0.001 | 0.0072 | 0.0032 | 0.0018 |

Example 2

In the same way as in Example 1, a steel capsule was charged with a mixture comprising 700 g of a 99.99% by weight lumpy electrolytic zinc and 14 g of a 95% by weight autocatalytically produced magnesium hydride (Tego Magnan®) and was heated to 550° C. in an induction furnace which had been rendered inert. After approx. 10 minutes, the reaction mixture was cooled. The result was a Zn regulus, the sawn surface of which did not exhibit any tarnishing even after it had been stored for months in the atmosphere.

The ultimate chemical analysis shown in Table 2 proves the separation effect achieved by the hydride treatment:

TABLE 2

| Specimen | Description | % Bi | % Cu | % Fe | % Pb | % Sn |
|---|---|---|---|---|---|---|
| Zn | (starting condition) | <0.001 | 0.0018 | 0.0025 | 0.0023 | 0.0015 |
| Zn | (after treatment with magnesium hydride) | <0.001 | <0.001 | 0.0011 | 0.0012 | <0.001 |

While this invention has been particularly shown and described with respect to preferred embodiments thereof, it will be understood by those skilled in the art that the foregoing and other changes in forms and details may be made without departing from the spirit and scope of the present invention. It is therefore intended that the present invention not be limited to the exact forms and details described and illustrated, but fall within the scope of the appended claims.

What is claimed is:

1. A process for treating molten metals comprising mixing at least one solid metal or metal alloy with at least one metal hydride to form a mixture of metals; and melting said mixture of metals in a molten bath, wherein said solid metal or metal alloy comprises at least one metal from Groups II–IV of the Periodic Table of Elements.

2. The process of claim 1 wherein said metal or metal alloy comprises a nonferrous metal or a nonprecious metal.

3. The process of claim 2 wherein said metal or metal alloy comprises magnesium, calcium, aluminum, silicon, titanium or zinc.

4. The process of claim 1 wherein said at least one metal hydride comprises the same or different metal as said metal or metal alloy.

5. The process of claim 4 wherein said at least one metal hydride comprises the same metal as said metal of said metal or metal alloy.

6. The process of claim 1 wherein said at least one metal hydride is a mixed metal hydride.

7. The process of claim 1 wherein said at least one metal hydride and said at least one metal or metal alloy are used in the same or different proportions.

8. The process of claim 1 wherein said at least one metal or metal alloy and said at least one metal hydride are used in a molar ratio of said at least one metal or metal alloy to said metal hydride of from 1:0.0001 to 1:100.

9. The process of claim 8 wherein said molar ratio of said metal or metal alloy to said metal hydride is from 1:0.001 to 1:0.01.

10. The process of claim 9 wherein said molar ratio of said metal or metal alloy to said metal hydride is from 1:005 to 1:0.03.

11. The process of claim 1 wherein said metal alloy comprises at least 30% by weight of said metal.

12. The process of claim 1 wherein said metal alloy is an Al—Mg alloy and said metal hydride is magnesium hydride.

13. The process of claim 1 wherein said at least one metal is zinc and said metal hydride is magnesium hydride.

14. The process of claim 1 wherein said at least one metal is magnesium and said metal hydride is magnesium hydride.

15. A process for treating molten metals comprising mixing at least one solid metal or metal alloy with at least one metal hydride to form a mixture of metals; melting said mixture of metals forming a molten mixture and cooling the molten mixture, wherein said solid metal or metal alloy comprises at least one metal selected from Groups II–IV of the Periodic Table of Elements.

* * * * *